US006460387B1

(12) United States Patent
Seto

(10) Patent No.: US 6,460,387 B1
(45) Date of Patent: Oct. 8, 2002

(54) PUNCH PRESS

(75) Inventor: Yoshiharu Seto, La Mirada, CA (US)

(73) Assignee: Amada MFG America, Inc., La Mirada, CA (US)

( * ) Notice: Subject to any disclaimer, the term of this patent is extended or adjusted under 35 U.S.C. 154(b) by 0 days.

(21) Appl. No.: 09/708,047

(22) Filed: Nov. 8, 2000

(51) Int. Cl.[7] ..... B21B 33/02

(52) U.S. Cl. ..... 72/3; 72/16.2; 72/17.3; 72/31.12; 72/420; 72/446

(58) Field of Search ..... 72/3, 4, 16.2, 17.3, 72/31.1, 31.12, 420, 421, 446

(56) References Cited

U.S. PATENT DOCUMENTS

| | | | | | |
|---|---|---|---|---|---|
| 4,987,765 | A | * | 1/1991 | Nishimura et al. | 72/420 |
| 5,350,347 | A | | 9/1994 | Fujiwara | |
| 5,367,935 | A | * | 11/1994 | Matsuda | 72/446 |
| 5,545,116 | A | * | 8/1996 | Seto | 72/446 |
| 5,882,285 | A | | 3/1999 | Seto et al. | |
| 6,109,090 | A | * | 8/2000 | Perazzalo | 72/446 |
| 6,109,159 | A | | 8/2000 | Seto | |
| 6,269,677 | B1 | * | 8/2001 | Torvinen et al. | 72/16.2 |

FOREIGN PATENT DOCUMENTS

| | | | | |
|---|---|---|---|---|
| JP | 6-126354 | * | 5/1994 | 72/4 |

* cited by examiner

*Primary Examiner*—Ed Tolan
(74) *Attorney, Agent, or Firm*—Greenblum & Bernstein, P.L.C.

(57) ABSTRACT

A punch press includes: a press main body; an upper turret member having a workpiece detecting plate; a lower turret member; a striker; striker ascending/descending means; a carriage with a clamper for holding a workpiece in order to position the workpiece between the upper turret member and the lower turret member; and carriage moving means to move the carriage in the horizontal direction. In the above construction, one end of a first conductive wire is electrically connected to the workpiece detecting plate; and one end of a second conductive wire is electrically connected to the press main body. The other end of the first conductive wire and the other end of the second conductive wire are electrically connected to a touch detecting unit to detect a touch between the workpiece detecting plate of the upper turret member and a workpiece clamped by the clamper.

8 Claims, 4 Drawing Sheets

PUNCH PRESS

BACKGROUND OF THE INVENTION

1. Field of the Invention

The present invention relates to a punch press for performing press working, punch out working, forming working or the like on a plate-shaped workpiece.

2. Description of the Related Art

A conventional punch press will be briefly explained in the following manner.

The conventional punch press is provided with a press main body, and the press main body is provided with an upper frame and a lower frame opposed to each other in a vertical direction. An upper turret member provided with a plurality of attachable/detachable punches is arranged on the upper frame, and an lower turret member provided with a plurality of attachable/detachable dies is arranged on the lower frame so as to be opposed to the upper turret member in a vertical direction. A striker for pressing a predetermined punch from the above is provided above the upper turret member so as to be movable upward and downward and an ascending/descending hydraulic cylinder for ascending/descending the striker is provided in the upper frame.

Furthermore, for positioning the workpiece at a predetermined position between the upper turret member and the lower turret member, a carriage base extending in left and right directions (namely, a X-axis direction) is provided on the lower frame movably in forward and rearward directions (namely, a Y-axis direction), and a carriage is provided on the carriage base so as to be movable in the X-axis direction. Here, the carriage base is moved in the Y-axis direction by driving of a Y-axis motor, and the carriage is moved in the X-axis direction by driving of a X-axis motor.

Accordingly, the carriage is moved in the X-axis direction by driving of the X-axis motor and the carriage base is moved in the Y-axis direction by driving of the Y-axis motor under the state where the plate-shaped workpiece has been clamped by clampers, so that the workpiece is moved in the X-axis direction and the Y-axis direction, thereby positioning the workpiece at the predetermined position between the upper turret member and the lower turret member. Then, the striker is descended by driving of the ascending/descending hydraulic cylinder so that the predetermined punch is pressed from the above by the striker. Thereby, the predetermined punch and the predetermined die are caused to cooperate with each other, so that a press working can be performed on the workpiece. Incidentally, after the striker is descended, it is ascended and returned back to its home or original position.

The above operation is repeated so that a series of press workings can be performed on a workpiece.

However, in the course of performing press working on a workpiece, such a deformation as a bending, a warping, or the like occurs in a portion of the workpiece due to that the workpiece collides with a die or the like or the former is caught by the latter. In the course of performing the press working, particularly a press forming working, there occurs a case that the workpiece is pushed upward by a die and a deformation occurs on the workpiece in many cases. When a deformation of a workpiece becomes larger, a portion of the workpiece comes in contact with the upper turret member or the like. When the press working continues under, this contacting state, the upper turret member or the like which is a constituting element for a punch press is injured and the workpiece is caught between the upper turret member and the lower turret member. Therefore, the workpiece must be released from between the upper turret member and the lower turret member, which results in elongation of the working time.

SUMMARY OF THE INVENTION

The present invention has been achieved with such points in mind.

It therefore is an object of the present invention to provide a punch press which can be prevented from being continued to punch on a workpiece when the workpiece is in contact with an upper turret member of the punch press, thereby the upper turret member or the like which is a constituent element for the punch press can be suppressed from being injured.

To achieve the object, according to a first aspect of the present invention, there is provided a punch press comprising: a press main body; an upper turret member being arranged on the press main body, the upper turret member being provided with a plurality of attachable/detachable punches; a lower turret member being arranged on the press main body so as to be opposed to the upper turret member in a vertical direction, the lower turret member being provided with a plurality of attachable/detachable dies; a striker being provided above the upper turret member, the striker being movable upward and downward for pressing a predetermined punch from the above; striker ascending/descending means for ascending/descending the striker; a carriage being movable in a horizontal direction, the carriage being provided with a damper for holding a workpiece in order to position the workpiece between the upper turret member and the lower turret member; and carriage moving means to move the carriage in the horizontal direction, wherein the upper turret member comprises: a turret member main body; a workpiece detecting plate being provided at a lower portion of the turret member main body; and an insulating body which insulates the turret member main body and the workpiece detecting plate from each other; wherein one end of a first conductive wire is electrically connected to the workpiece detecting plate; wherein the damper and the carriage are electrically connected to the press main body; wherein one end of a second conductive wire is electrically connected to the press main body; wherein the other end of the first conductive wire and the other end of the second conductive wire are electrically connected to a touch detecting unit to detect a touch between the workpiece detecting plate of the upper turret member and a workpiece which is clamped by the clamper.

In the punch press according to the first aspect, under a state where a plate-shaped workpiece is clamped by the clamper, the carriage is moved in a horizontal direction by driving of the carriage moving means so that the workpiece is moved in the horizontal direction to be positioned at a predetermined position between the upper turret member and the lower turret member. Then, the striker is descended by driving of the striker driving means and a predetermined punch is pressed from the above by the striker. Thereby, the predetermined punch and a predetermined die are caused to cooperate with each other so that a press working can be performed on the workpiece. Incidentally, after the striker is descended, it is ascended and returned back to its home position. By repeating the above operations, a series of press workings can be performed on the workpiece.

When a portion of the workpiece comes in contact with the workpiece detecting plate while the series of press workings are being performed on the workpiece, it is detected by the touch detecting unit that the first conductive wire and the second conductive wire are made conductive to each other through the workpiece, the damper and the carriage. That is, it is detected by the touch detecting unit that a deformation such as a bending, warping or the like has occurred in the workpiece and a portion of the workpiece has come in contact with the workpiece detecting plate on the upper turret member.

Therefore, under the state where the portion of the workpiece is in contact with the upper turret member, the press working is prevented from being continued on the workpiece so that the upper turret member or the like which is a constituent element for the punch press can be suppressed from being injured, and the workpiece is prevented from being caught between the upper turret member and the lower turret member so that working. efficiency can be improved.

According to a second aspect of the present invention, as it depends from the first aspect, there is provided a punch press further comprising: control means for performing control so as to stop driving of the striker ascending/descending means and the carriage moving means when it is detected by the touch detecting unit that the first conductive wire and the second conductive wire have been made conductive to each other.

In the punch press according to the second aspect, when it is detected by the touch detecting unit that the first conductive wire and the second conductive wire have been made conductive to each other, a control is performed by the control means so as to stop driving of the striker ascending/descending (driving) means and the carriage moving means.

In this connection, under the state where a portion of the workpiece is in contact with the upper turret member, the press working is securely prevented from being continued on the workpiece, so that the effect obtained according to the first aspect can further be improved.

According to a third aspect of the present invention, as it depends from the first or the second aspect, there is provided a punch press wherein: the upper turret member is constituted by a rotatable upper turret; the lower turret member is constituted by a rotatable lower turret; and turret rotating means for rotating the upper turret and the lower turret in synchronism with each other is provided in the punch press.

In the punch press according to the third aspect, the upper turret and the lower turret are rotated in synchronism with each other by driving of the turret rotating means before the striker is descended by the striker ascending/descending means, so that a predetermined punch and a predetermined die can be positioned in a working area.

According to a fourth aspect of the present invention, as it depends from one aspect among the first aspect to the third aspect, there is provided a punch press further comprising: control means for performing control so as to stop driving of the striker ascending/descending means, the carriage moving means and the turret rotating means when it is detected by the touch detecting unit that the first conductive wire and the second conductive wire have been made conductive to each other.

In the punch press according to the fourth aspect, when it is detected by the touch detecting unit that the first conductive wire and the second conductive wire have been made conductive to each other, a control is performed by the control means so as to stop driving of the striker ascending/descending (driving) means, the carriage moving means and the turret rotating means.

Therefore, under the state where a portion of the workpiece is in contact with the rotatable upper turret (the upper turret member), the press working is securely prevented from being continued on the workpiece, so that the effect obtained according to the first aspect can further be improved.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
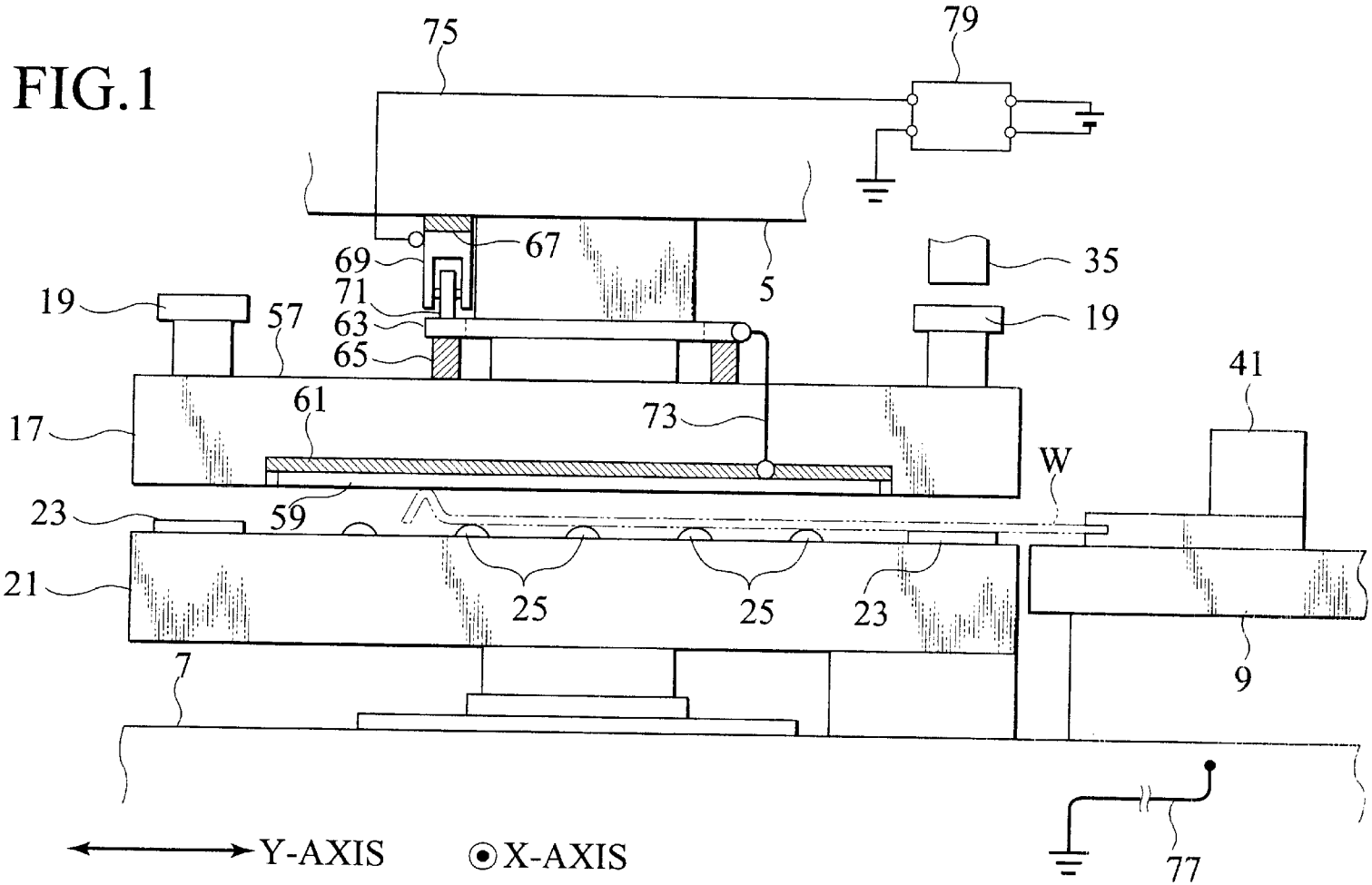
FIG. 1 is a view showing a feature portion of a punch press according to an embodiment of the present invention.

There will be detailed below the preferred embodiments of the present invention with reference to the accompanying drawings. Like members are designated by like reference characters.

Figure 3:
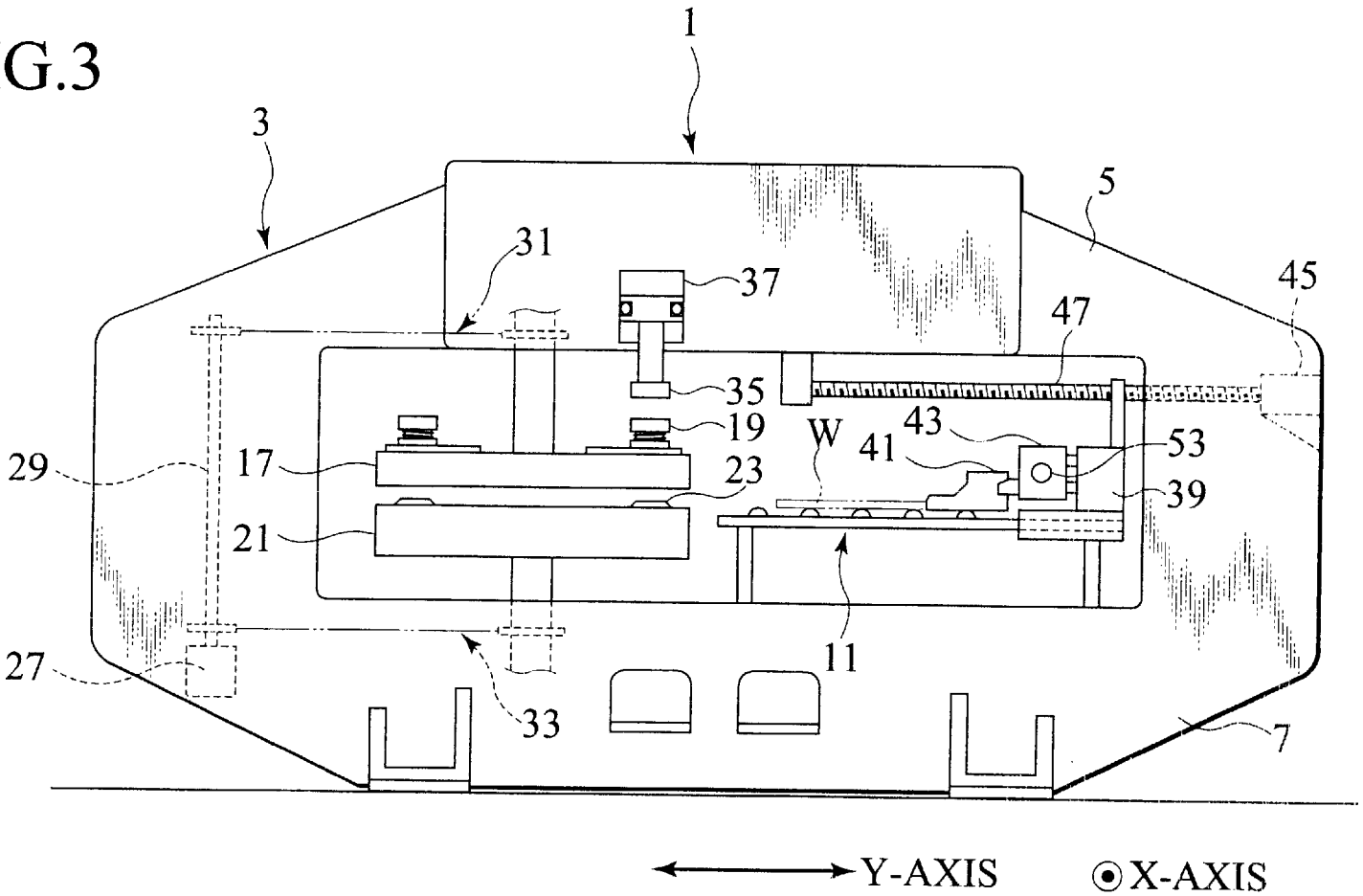
FIG. 3 is a side view of the punch press.
Figure 4:
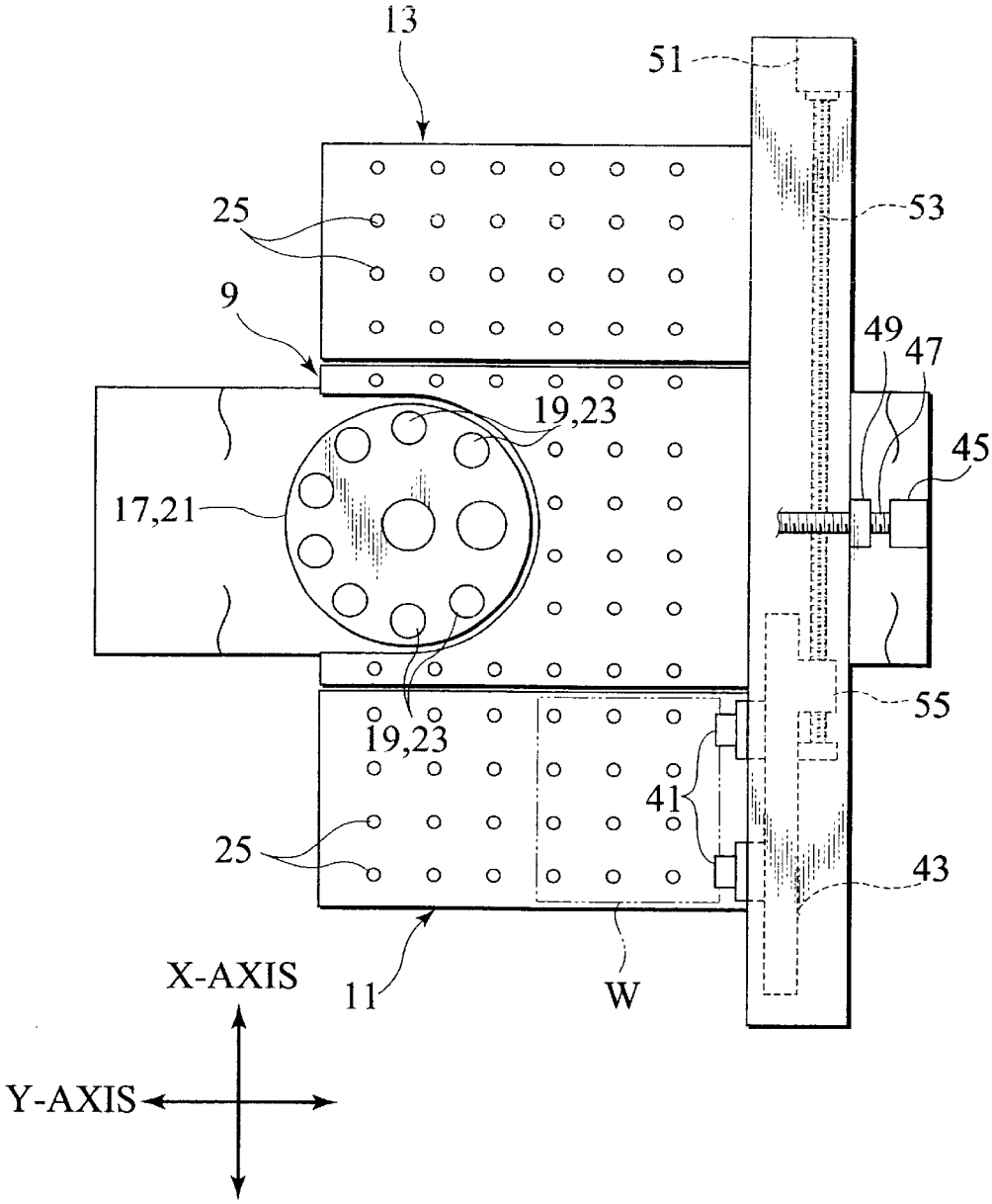
FIG. 4 is a plan view of the punch press.

As shown in FIGS. 3 and 4, a punch press 1 according to an embodiment of the present invention comprises a bridge-shaped press main body 3 as a base, and the press main body 3 comprises an upper frame 5 and a lower frame 7 which are opposed to each other in a vertical direction (upward and downward directions on FIG. 3, and surface and back surface directions on FIG. 4). A fixed table 9 is provided on the lower frame 7, and a pair of movable tables 11, 13 are provided on both left and right (surface and back directions on FIG. 3, and upward and downward direction on FIG. 4) sides of the fixed table 9 on the lower frame 7 so as to be movable in forward and rearward directions (namely, Y-axis direction, or left and right directions on FIGS. 3 and 4). Here, the fixed table 9 and the movable tables 11, 13 are respectively provided with a number of free ball bearings 15 for supporting a plate-shaped workpiece W in a rollable manner.

A circular upper turret 17 is rotatably provided on the upper frame 5, and a plurality of attachable/detachable punches 19 are arranged on the upper turret 17 properly in an annular manner. A circular lower turret 21 is provided rotatably on the lower frame 7 so as to be opposed to the upper turret 17 in a vertical direction, and a plurality of attachable/detachable dies 23 are arranged on the lower turret 21 properly in an annular manner. Incidentally, a plurality of free ball bearings for supporting the workpiece W in a rollable manner are provided on a central portion of the lower turret 21.

For rotating the upper turret 17 and the lower turret 21 in synchronism with each other, a rotating servo motor 27 is provided at a proper portion of the press main body 3. A driving shaft 29 extending vertically is provided to an output shaft of the rotating servo motor 27 integrally therewith, and the upper turret 17 and the lower turret 21 are coupled to each other so as to interlock by the driving shaft 29 through coupling mechanisms (each comprising a chain and sprocket) 31, 33. Here, a predetermined punch 15 and a predetermined die 19 are structured such that they can be indexed in a working area A by rotating the upper turret 17 and the lower turret 21.

A striker 35 for pressing the predetermined punch 19 from the above is provided above the upper turret 17 such that it can be ascended/descended, and an ascending/descending hydraulic cylinder 37 for ascending/descending the striker 35 is provided on the upper frame 5. Here, in a case of a crank type punch press, the striker 35 is ascended/descended by driving of an ascending/descending motor for rotating a crank shaft instead of driving of the ascending/descending hydraulic cylinder 37.

For positioning the workpiece W at a predetermined position between the upper turret 17 and the lower turret 21, a carriage base 39 extending in left and right directions (namely, in a X-axis direction) is provided on the lower frame 7 movably in a Y-axis direction, and a carriage 43 provided with a plurality of clamps 41 for holding a workpiece W is provided on the carriage base 39 movably in the X-axis direction. Here, the carriage base 39 is coupled to a pair of movable tables 11, 13 integrally therewith, and it is moved in the Y-axis direction together with the pair of movable tables 11, 13.

For moving the carriage base 39 in the Y-axis direction, a Y-axis servo motor 45 is provided at a proper position on the press main body 3, a Y-axis ball screw 47 which is coupled to the Y-axis servo motor 45 in an interlocking manner and which extends in the Y-axis direction is provided rotatably on the upper frame 5, and a nut member 49 engaging the Y-axis ball screw 47 in a threading manner is provided on the carriage base 39. Also, for moving the carriage 43 in the X-axis direction, a X-axis servo motor 51 is provided on the carriage base 39, a X-axis ball screw 53 which is coupled to the X-axis servo motor 51 in an interlocking manner and which extends in the X-axis direction is provided on the carriage base 39, and a nut member 55 engaging the X-axis ball screw 53 in a threading manner is provided on the carriage 43.

Figure 2:
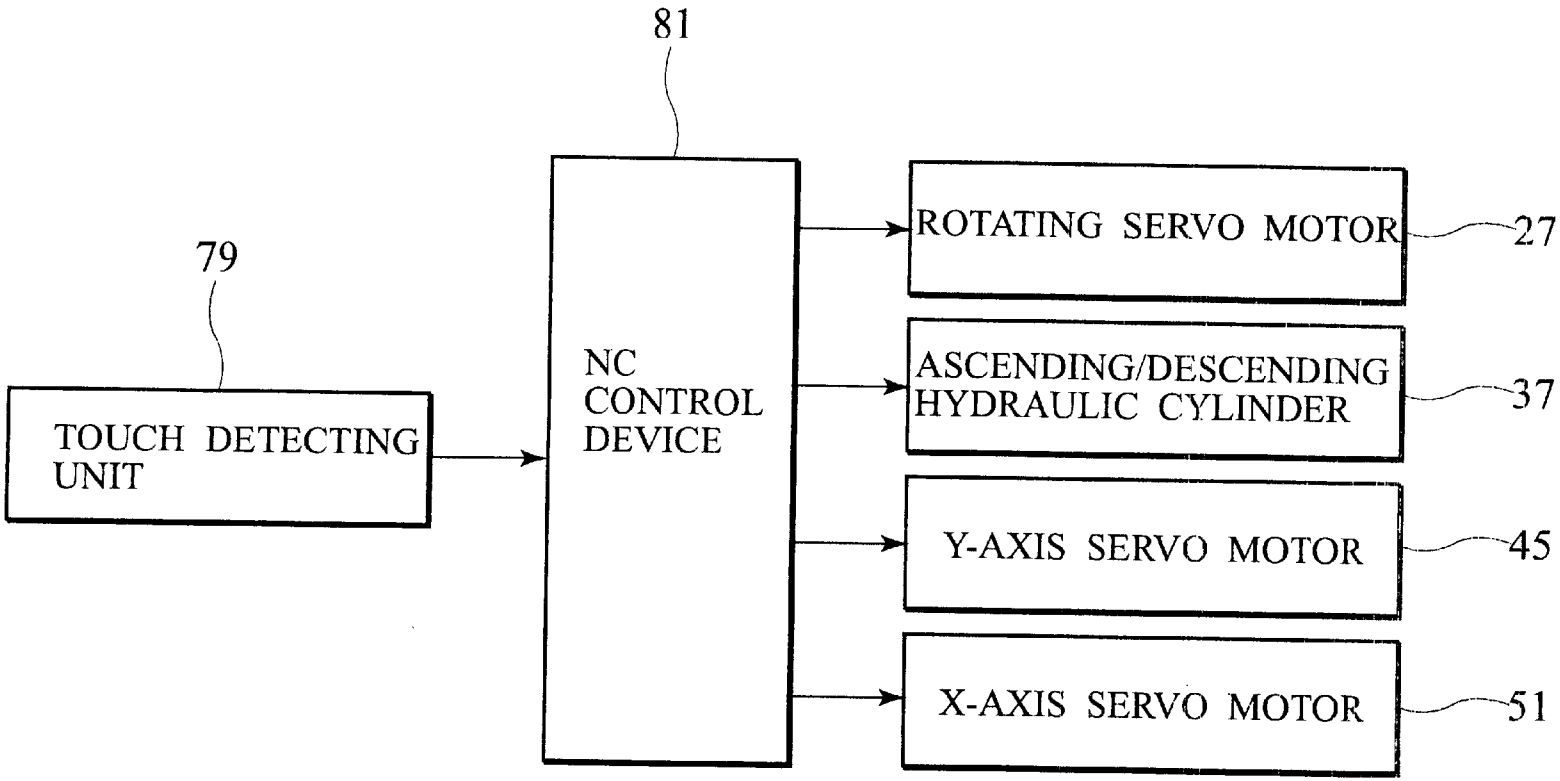
FIG. 2 is a control block diagram of the punch press.

As shown in FIGS. 1 to 3, the upper turret 27 comprises a turret main body 57, a workpiece detecting plate 59 provided integrally with a lower portion (a lower portion on FIGS. 1 and 3) of the turret main body 57, a lower insulating body 61 for insulating the turret main body 57 and the workpiece detecting plate 59 from each other, an annular connecting plate 63 provided integrally with an upper portion of the turret main body 57, and an upper insulating body 65 for insulating the turret main body 57 and the connecting plate from each other. A supporting bracket 69 is provided at a position near the upper turret 17 on the upper frame 5, and a roller 71 which rolls on the connecting plate 63 is rotatably provided on the supporting bracket 69. The supporting bracket 69 is structured such that it is electrically connected to the connecting plate 63 through the roller 71.

One end of a first conductive wire 73 is electrically connected to the workpiece detecting plate 59, and the other end thereof is electrically connected to the connecting plate 63. Also, one end of another first conductive wire 75 is electrically connected to the connecting plate 63, and the other end thereof is electrically connected to a grounding member.

The clamps 41, the carriage 43 and the carriage base 39 are structured so as to be electrically connected to the lower frame 7. One end of a second conductive wire 77 is electrically connected to the lower frame 7, and the other end thereof is electrically connected to a grounding member.

A touch detecting unit 79 is disposed in an intermediate portion of the first conductive wire 75, and the touch detecting unit 79 is for detecting that a portion of the workpiece W has come in contact with the workpiece detecting plate 59 so that the first conductive wires 73, 75 and the second conductive wire 77 have been made conductive to each other. The touch detecting unit 79 is connected to an NC control device 81, and the NC control device 81 performs control so as to stop driving of the rotating servo motor 27, the ascending/descending hydraulic cylinder 37, the Y-axis servo motor 45, and the X-axis servo motor 51 when the first conductive wires 73, 75 and the second conductive wire 77 have been made conductive to each other.

Next, operation of the embodiment of the invention will be explained.

Under a state where a plate-shaped workpiece W has been clamped by the clamps 41, the carriage 43 is moved in the X-axis direction by driving of the X-axis servo motor 51 and the carriage 43 is moved in the y-axis direction by driving of the Y-axis servo motor 45, so that the workpiece W is moved in the X-axis direction and in the Y-axis direction to be positioned at a predetermined position between the upper turret 17 and the lower turret 21. Also, the upper turret 17 and the lower turret 21 are moved in synchronism with each other by driving of the rotating servo motor 27 so that a predetermined punch 19 and a predetermined die 23 are positioned in the working area A. Then, the striker 35 is descended by driving of the ascending/descending hydraulic cylinder 37 so that the predetermined punch 19 is pressed from the above by the striker 35. Thereby, the predetermined punch 19 and the predetermined die 23 are caused to cooperate with each other so that a press working can be performed on the workpiece W. Incidentally, after the striker 35 is descended, it is ascended to return back to the home position.

By repeating the above operation, a series of press working can be performed on the workpiece W.

When a portion of the workpiece W comes in contact with the workpiece detecting plate 59 on the upper turret 17 while a series of press workings are being performed on the workpiece W, it is detected by the touch detecting unit 79 that the first conductive wires 73, 75 and the second conductive wire 77 have been made conductive to each other. In other words, it is detected by the touch detecting unit 79 that a deformation such as a bending, warping or the like has occurred in the portion of the workpiece W and the portion of the workpiece W has come in contact with the workpiece detecting plate 59 on the upper turret 17. Then, when it is detected by the touch detecting unit 79 that the first conductive wires 73, 75 and the second conductive wire 77 have been made conductive to each other, control is made by the NC control device 81 so as to stop driving of the rotating servo motor 27, the ascending/descending hydraulic cylinder 37, the Y-axis servo motor 45 and the X-axis servo motor 51.

According to the embodiment of the present invention, as mentioned above, since it is detected by the touch detecting unit 79 that a deformation such as a bending, warping or the like has occurred in a portion of a workpiece W and the portion of the workpiece W has come in contact with the workpiece detecting plate 59 on the upper turret 17, and furthermore control is made by the NC control device 81 so as to stop driving of the rotating servo motor 27, the ascending/descending hydraulic cylinder 37, the Y-axis servo motor 45 and the X-axis servo motor 51, a press working on the workpiece W can securely be prevented from continuing under a state where a portion of the workpiece W is in contact with the upper turret 17, and the upper turret 17 or the like which is a constituting element for the punch press 1 can be suppressed from being injured. In addition, the workpiece W is prevented from being caught or jammed between the upper turret 17 and the lower turret 21 so that a working efficiency can be improved.

While preferred embodiments of the present invention have been described using specific terms, such description is for illustrative purposes, and it is to be understood that changes and variations may be made without departing from the spirit or scope of the following claims.

What is claimed is:

1. A punch press, comprising:

a press main body;

an upper turret member being arranged on the press main body, the upper turret member being provided with a plurality of attachable/detachable punches;

a lower turret member being arranged on the press main body so as to be opposed to the upper turret member in a vertical direction, the lower turret member being provided with a plurality of attachable/detachable dies;

a striker being provided above the upper turret member, the striker being moveable upward and downward for pressing a predetermined punch from above;

striker ascending/descending means for ascending/descending the striker;

a carriage being movable in a horizontal direction, the carriage being provided with a clamper for holding a workpiece in order to position the workpiece between the upper turret member and the lower turret member; and carriage moving means to move the carriage in the horizontal direction;

wherein the upper turret member comprises:

a turret member main body;

a workpiece detecting plate being provided at a lower portion of the turret member main body; and an insulating body which insulates the turret member main body and the workpiece detecting plate from each other;

wherein one end of a first conductive wire is electrically connected to the workpiece detecting plate;

wherein the clamper and the carriage are electrically connected to the press main body;

wherein one end of a second conductive wire is electrically connected to the press main body; and wherein the other end of the first conductive wire and the other end of the second conductive wire are electrically connected to a touch detecting unit to detect a touch between the workpiece detecting plate of the upper turret member and a workpiece which is clamped by the clamper.

2. A punch press according to claim 1, further comprising:

control means for performing control so as to stop driving of the striker ascending/descending means and the carriage moving means when it is detected by the touch detecting unit that the first conductive wire and the second conductive wire have been made conductive to each other.

3. A punch press according to claim 2, wherein the upper turret member is constituted by a rotatable upper turret;

wherein the lower turret member is constituted by a rotatable lower turret; and wherein turret rotating means for rotating the upper turret and the lower turret in synchronism with each other is provided in the punch press.

4. A punch press according to claim 3, further comprising:

control means for performing control so as to stop driving of the striker ascending/descending means, the carriage moving means and the turret rotating means when it is detected by the touch detecting unit that the first conductive wire and the second conductive wire have been made conductive to each other.

5. A punch press, comprising:

a press main body;

an upper turret provided on the press main body, the upper turret being provided with a plurality of attachable and detachable punches;

a lower turret provided on the press main body so as to be opposed to the upper turret in a vertical direction, the lower turret being provided with a plurality of attachable and detachable dies;

a striker provided above the upper turret, the striker being moveable upwardly and downwardly to press a predetermined punch from above;

a striker mover configured to move the striker upwardly and downwardly;

a carriage configured to be movable in a horizontal direction, the carriage being provided with a clamp to hold a workpiece in order to position the workpiece between the upper turret and the lower turret; and carriage movers configured to move the carriage in the horizontal direction;

wherein the upper turret comprises:

a turret member main body;

a workpiece detecting plate provided at a lower portion of the turret main body; and an insulating body that insulates the turret main body and the workpiece detecting plate from each other;

wherein one end of a first conductive wire is electrically connected to the workpiece detecting plate;

wherein the clamp and the carriage are electrically connected to the press main body;

wherein one end of a second conductive wire is electrically connected to the press main body; and wherein the other end of the first conductive wire and the other end of the second conductive wire are electrically connected to a touch detecting unit to detect a touch between the workpiece detecting plate of the upper turret and a workpiece which is clamped by the clamp.

6. The punch press according to claim 5, further comprising:

a controller that stops movement of the striker mover and the carriage mover when it is detected by the touch detecting unit that the first conductive wire and the second conductive wire have been made conductive to each other.

7. The punch press according to claim 6, wherein the upper turret includes a rotatable upper turret;

wherein the lower turret includes a rotatable lower turret; and wherein a turret rotator configured to rotate the upper turret and the lower turret in synchronism with each other is provided in the punch press.

8. The punch press according to claim 7, further comprising:

a controller that stops movement of the striker mover, the carriage mover, and the turret rotator when it is detected by the touch detecting unit that the first conductive wire and the second conductive wire have been made conductive to each other.

* * * * *